US005263855A

United States Patent [19]

Watson et al.

[11] Patent Number: 5,263,855

[45] Date of Patent: Nov. 23, 1993

[54] LOW PRESSURE DROP ROTATING VERTICAL VANE INLET PASSAGE FOR COAL PULVERIZER

[75] Inventors: George B. Watson, Alliance; Robert J. Giammaruti, North Canton, both of Ohio

[73] Assignee: The Babcock & Wilcox Company, New Orleans, La.

[21] Appl. No.: 31,044

[22] Filed: Mar. 11, 1993

Related U.S. Application Data

[63] Continuation of Ser. No. 882,733, May 14, 1992, abandoned.

[51] Int. Cl.[5] ..... B02C 15/00

[52] U.S. Cl. ..... 241/119; 241/121

[58] Field of Search ..... 241/80, 97, 119, 121

[56] References Cited

U.S. PATENT DOCUMENTS

| | | | |
|---|---|---|---|
| 2,275,595 | 3/1942 | Schwartz | 241/103 X |
| 2,378,681 | 6/1945 | Barley et al. | 241/103 X |
| 2,473,514 | 6/1949 | Ebersole | 241/103 X |
| 2,545,254 | 3/1951 | Bice | 241/103 X |
| 4,264,041 | 4/1981 | Kitto, Jr. et al. | 241/103 X |
| 4,602,745 | 7/1986 | Maliszewski et al. | 241/119 |
| 4,605,174 | 8/1986 | Maliszewsky et al. | 241/119 X |
| 4,687,145 | 8/1987 | Dougan et al. | 241/119 X |
| 4,721,258 | 1/1988 | Dougan et al. | a41/119 X |
| 4,752,037 | 7/1988 | Farris et al. | 241/119 X |
| 5,020,734 | 6/1991 | Novotny et al. | 241/119 |

FOREIGN PATENT DOCUMENTS

| | | | |
|---|---|---|---|
| 264103 | 4/1988 | European Pat. Off. | 241/119 |
| 3344223 | 6/1985 | Fed. Rep. of Germany | 241/119 |
| 264136 | 1/1989 | German Democratic Rep. | 241/119 |
| 587989 | 1/1978 | U.S.S.R. | 241/119 |
| 1094617 | 5/1984 | U.S.S.R. | 241/121 |

*Primary Examiner*—Mark Rosenbaum
*Assistant Examiner*—Frances Chin
*Attorney, Agent, or Firm*—Daniel S. Kalka; Vytas R. Matas; Robert J. Edwards

[57] ABSTRACT

An annular passage arrangement for a pulverizer includes vertically extending inner and outer passage walls which define a "boxed" annular passage. The annular passage space has an inlet for receiving flow from an air plenum and an outlet for vertically channeling the flow into a pulverizing zone. The annular passage is divided by vanes having a tapered end at the inlet end of the passage and an outlet end located at the passage outlet. The outlet end of each vane extends at an acute angle to the horizontal and the tapered end of each vane is vertically oriented within the annular passage. This vane orientation reduces pressure drop as the plenum air is fanned up into the pulverizing zone. Flow contouring plates below the passage inlet reduce flow disturbances and create a more uniform flow pattern up and into the passage inlet.

6 Claims, 2 Drawing Sheets

LOW PRESSURE DROP ROTATING VERTICAL VANE INLET PASSAGE FOR COAL PULVERIZER

This is a continuation of application Ser. No. 07/882,733 filed May 14, 1992 abandoned.

BACKGROUND OF THE INVENTION

1. Field of the Invention

The present invention relates in general to pulverizers for pulverizing coal, and in particular to a new and useful rotating vertical vane inlet throat design for such pulverizers which has a reduction in pressure drop characteristic.

2. Description of the Related Art

One type of known coal pulverizing mill (pulverizer) is a slow speed, roll-and-race-type pulverizer that uses three large-diameter grinding rolls to crush the coal. Primary air enters the pulverizer through a radial inlet duct, moves into a low-velocity air plenum, and is then accelerated and oriented by a series of stationary throats in a ring that surrounds the grinding zone. At the outlet of the throat or annular passage, the pulverized coal particles are entrained by the high-speed airflow. The velocity of the air is then reduced in the main pulverizer housing causing the larger particles to be returned directly to the grinding zone for further crushing, while the smaller particles are carried up through the classifier for final sizing.

A large portion of the primary air pressure drop is due to losses across the rotating annular passage. In some known pulverizers, the primary air pressure drop can be about 40% higher than other mills containing different, rotating annular passage designs. Due to this higher pressure drop, more fan power is required to operate the mill. This results in a large power penalty due only to the annular passage design.

A known design illustrated in FIGS. 1 and 2, is a modified version of the earlier stationary annular passage design of the early 1980's. This design consists of forty-two passage ports (10) made up of fourteen separate castings mounted to the top and bottom of a grinding table (16). The annular passage is divided into the individual ports (10) through the use of flow vanes (12). The vanes extend from the passage inlet (10*a*) to the passage outlet (10*b*) and are included at an angle (14) of 30° from the horizontal and an angle (18) of 15° from the vertical toward a grinding zone (20). The outer passage wall (22) is stationary while the remainder of the passage including its inner wall (24) and the vanes (12) is rotated with the grinding table (16). The air flow is initially oriented by a tear-drop shape (12*a*) at the leading edge of the vane (12) and is accelerated to promote a uniform velocity profile over an airfoil shape (12*b*) on a portion of the upper surface. Table (16) rotates within a housing (6), about a vertical axis. The outer passage wall (22) is supported in the housing and the housing encloses the grinding zone (20). The function of the vanes to accelerate and orient the flow through the throat is described in U.S. Pat. No. 4,264,041.

Other pertinent existing prior art relating to pulverizer throat or annular passage designs are U.S. Pat. No. 2,275,595 (Schwartz, '595); U.S. Pat. No. 2,378,681 (Bailey, et al, '681); U.S. Pat. No. 2,473,514 (Ebersole, '514); and U.S. Pat. No. 2,545,254 (Bice, '254), all of which are assigned to The Babcock & Wilcox Company. Schwartz '595, discloses curved passages fanning an annular passage discharging scavenging air in the direction of the grinding elements. Bailey, et al '681, discloses a design for constant air velocity through the annular passage. Ebersole '541, discloses an adjustable annular passage, and Bice '254, discloses an eccentric annular passage design for air distribution.

SUMMARY OF THE INVENTION

The present invention involves an improved rotating vertical vane inlet annular passage design which has substantially less pressure drop across it. The reduction in pressure drop is achieved by creating a more uniform velocity distribution across the rotating annular passage. This is accomplished by redesigning how the primary plenum air enters, travels through, and exits each passage port. By creating a more uniform velocity distribution, the overall velocity level may be reduced since regions of low velocity along the annular passage need not be compensated for. This results in a velocity pressure drop reduction across the entire rotating annular passage.

An object of the invention is to allow the inlet air to enter the annular passage vertically, eliminating any unbalance in the flow distribution. Another object of the invention is to provide a design such that the bottom of the vane is tapered to allow a smooth transition into the annular passage as the air travels up into the annular passage.

A further object of the invention is to provide an airfoil that reduces the area and accelerates the flow creating a uniform velocity distribution across each port so that when the flow is then decelerated, there is a reduction in pressure drop as the flow exits the annular passage.

A further object of the invention is to provide a design with a reverse angle vane orientation in order to take advantage of the fanning effect produced by the rotation of the annular passage, such that there is a reduction in pressure drop as the plenum air is fanned up and into the grinding zone.

Another object of the invention is to provide flow-contouring plates below the annular passage inlet to reduce recirculation zones resulting from sharp corners or step changes in area in the mill plenum in order to create a more uniform flow pattern up and into the annular passage inlet.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
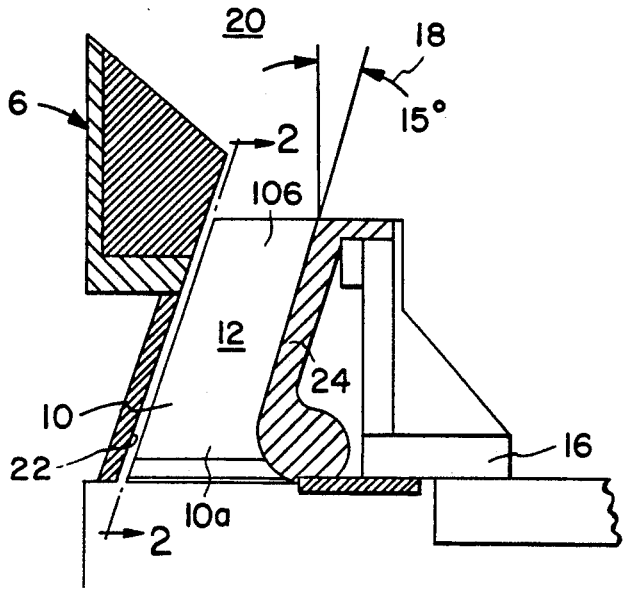
FIG. 1 PRIOR ART
FIG. 1 is a vertical section view of the annular passage area for a known air-swept pulverizer or mill.
Figure 2:
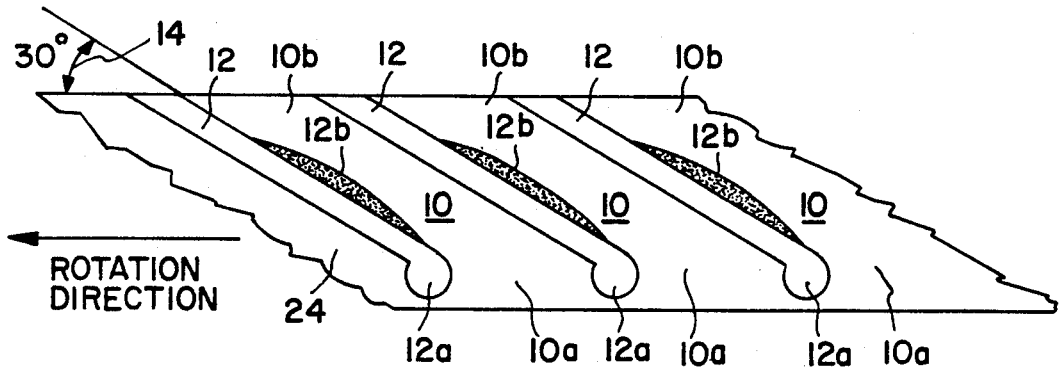
FIG. 2 PRIOR ART
FIG. 2 is a vertical elevational view taken along line 2—2 of FIG. 1.
Figure 3:
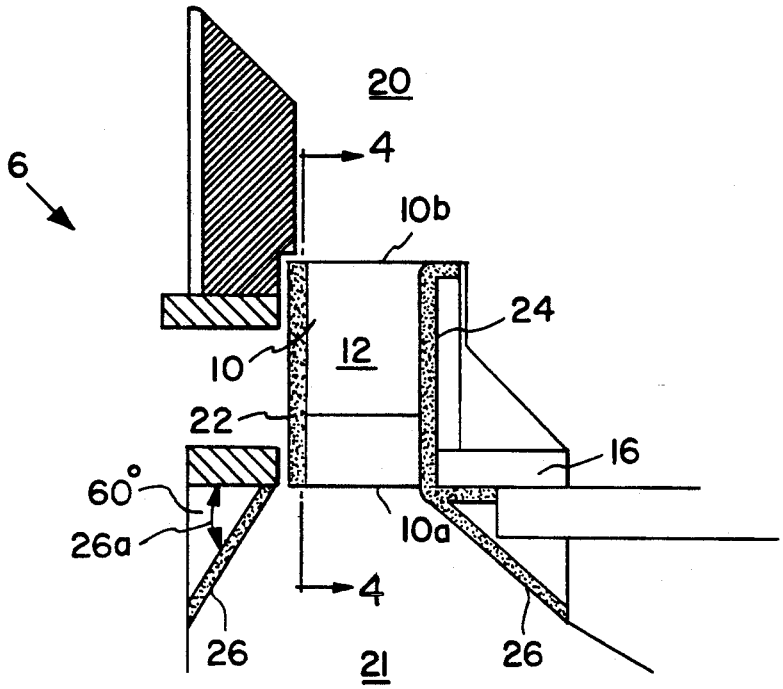
FIG. 3 is a view similar to FIG. 1 of the annular passage area of a pulverizer or mill constructed according to the present invention.
Figure 4:
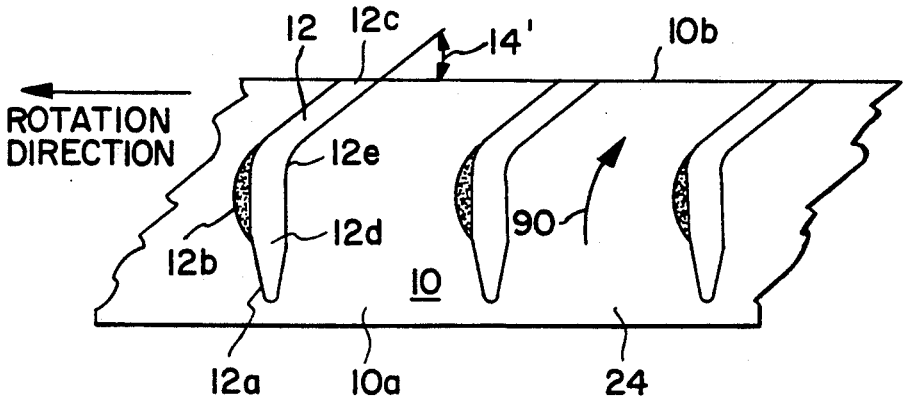
FIG. 4 is a vertical elevation taken along line 4—4 of FIG. 3.

In FIGS. 3 and 4, the same reference numerals are used as those in FIGS. 1 and 2 for the same or functionally similar parts.

Referring now in particular to FIGS. 3 and 4, the invention embodied therein comprises an improved annular passage arrangement for a pulverizer having a fixed housing (6) with a central axis. Grinding table (16) rotates around the central axis for pulverizing particles, in particular coal, in a conventional fashion. Grinding table (16) rotates in the rotation direction indicated by the arrow in FIG. 4. Air supplied to an inlet plenum (21) travels upwardly and vertically through an annular passage provided between an outer passage wall (22) and an inner passage wall (24). The annular passage is further divided into individual passage ports (10) by vanes (12), distributed in a circumferentially spaced manner around the vertical axis of the pulverizer. As best shown in FIG. 3, one novel feature of the present invention is that both the outer and inner passage walls (22, 24) are vertical which forms a "boxed" annular passage (10), that is parallel to the rotation axis, rather than being at an angle to the axis as in the prior art (see angle (18) in FIG. 1).

The current radial inlet configuration of FIG. 3 allows for an inlet air flow (90) to enter the annular passage vertically through the passage inlet (10*a*) and exiting the passage outlet (10*b*) into the grinding zone (20).

Another novel feature of the present invention, shown in FIG. 4, is that the vane (12) has a tapered end (12*a*) at the passage inlet (10*a*) which allows for a smooth transition of flow (90) into the throat inlet (10*a*). As the flow (90) travels up into the throat inlet (10*a*), the flow (90) travels through the port (10) from the tapered end (12*a*) over a vertical section (12*d*) of the vane which is parallel to the control axis. The vane (12) has a vane curve (12*e*) located above the vertical section (12*d*) and the tapered end (12*a*). The vane curve (12*e*) leads to an outlet end (12*c*) of the vane (12) located at the throat outlet (10*b*).

The airfoil shape (12*b*) is located at the vertical section (12*d*) for reducing the area and accelerating the flow (90), creating a uniform velocity distribution across each port (10). The flow (90) is then decelerated, allowing for a reduction in pressure drop as it exits the passage outlet (10*b*).

Each vane (12) is at an acute angle (14') to the horizontal, which is advantageously but not necessarily 45°, in a direction so that the tapered end (12*a*) of each vane is upstream of the outlet end (12*c*) of each vane (12) with respect to the rotation direction of the grinding table (16). This is reversed from the angular orientation of the prior art as shown at angle (14) in FIG. 2. Vanes (12) continue to have the upstream or tapered end (12*a*) which is tapered and the intermediate air foil shape (12*b*), but both are reversed in orientation with respect to the rotation direction and as compared with the prior art.

The design of this present invention takes advantage of the fanning effect produced by the rotation of the passage due to the reverse angle vane orientation. This vane orientation allows for a reduction in pressure drop as the plenum air is fanned up (not down as is currently done) and into the grinding zone (20).

Flow-contouring plates (26) are provided below the passage inlet (10*a*). The plates (26) reduce recirculation zones resulting from sharp corners or step changes in area in the mill plenum. Elimination of these flow disturbances will help create a more uniform flow pattern up and into the passage inlet (10*a*).

The flow-contouring plates (26) extend at an acute angle (26*a*), for example 60°, with respect to the vertical axis, along the inner periphery of the entry area for the ports (10) within the inlet plenum (21).

Use of the combined rotating annular passage designs described above provides the following advantages over the current design.

a) Vertical inlet to the annular passage results in a more uniform distribution of the plenum air which results in lower pressure drop.

b) The present invention will reduce the turning loss now found in existing rotating annular passage designs. This is done by having the flow enter vertically over a tapered inlet and turn over a gradual angle while accelerating. The sharp inlet bends on one-half of the rotating annular passage, inherent in the current design with the radial inlet, are eliminated resulting in a reduction in pressure drop.

c) Reduction in erosion of mill components such as the roll wheel hubs and the mill wall housing due to vertical inner and outer passage walls, and a reduced horizontal component of velocity exiting the annular passage by way of an increased vane angle.

d) Reduction in energy spent swirling or rotating the coal bed more than necessary for proper mill operation. This is due to the reduction in the horizontal component velocity by way of an increased vane angle.

e) The increased vane angle results in better utilization of the vertical component of velocity in suspending coal particles.

f) The "boxed" annular passage and flow contour plates minimize the flow disturbances in and before the annular passage leading to a more uniform velocity distribution through the annular passage.

g) The reverse vane orientation takes advantage of the fanning effect produced by the annular passage rotation.

h) Reduction in vane length reduces friction losses as well as component weight.

i) Reduction in vane length, along with the vertical inner and outer walls, provides for easier installation and maintenance.

j) The vertical inner and outer passage make for a less complex casting design, which reduces the probability of manufacturing errors.

Further, although the economic advantages of casting each passage section are known, the new throat design of the invention may be manufactured partly or entirely through weld and plate technology.

While specific embodiments of the invention have been shown and described in detail to illustrate the application of the principles of the invention, it will be understood that the invention may be embodied otherwise without departing from such principles.

What is claimed is:

1. An annular passage arrangement for a pulverizer, comprising:

a fixed housing having an axis and defining an inlet plenum for air into the pulverizer and a grinding zone where air picks up and conveys articles pulverized in the pulverizer;

a grinding table mounted for rotation about the axis in the housing;

an outer wall in the housing, the outer wall being vertically oriented parallel to the axis;

an inner wall connected to the table and positioned in the housing, the inner wall being spaced inwardly from the outer wall for defining an annular passage therebetween, the inner wall being vertically oriented parallel to the axis; and a plurality of vanes extending radially between the inner and outer walls for dividing the annular passage into a plurality of circumferentially spaced passage ports between the inner and outer walls, each of said vanes being curved such that an outlet end of each vane is inclined at an acute angle to the horizontal upto a vertical section of each vane, and the vertical section of each vane extending to an inlet end and being vertically oriented and substantially parallel to the axis, the inlet end of each vane adjacent the inlet plenum is tapered and is upstream in the rotation direction of the outlet end of each vane adjacent the grinding zone.

2. An annular passage arrangement according to claim 1, wherein each port includes an inner inlet end below the grinding table, the annular passage arrangement including a plurality of inclined flow-contouring plates in the inner portion of the inlet end of each port for contouring air flow from the inlet plenum into each port.

3. An annular passage arrangement according to claim 2, wherein the inclined flow-contouring plates are inclined at an acute angle to the horizontal.

4. An annular passage arrangement according to claim 3, wherein the angle is 60°.

5. An annular passage arrangement according to claim 1, wherein the outer wall is connected to the inner wall through the vanes and rotates with the grinding table.

6. An annular passage arrangement according to claim 1, wherein each of the vanes further includes an airfoil shape located at the vertical section for reducing area and accelerating flow.

* * * * *